United States Patent [19]

Rideout

[11] Patent Number: 4,676,407

[45] Date of Patent: Jun. 30, 1987

[54] MOUNTING CAP WITH EXTENDED SLEEVE

[75] Inventor: Gerald E. Rideout, Watertown, Conn.

[73] Assignee: Risdon Corporation, Naugatuck, Conn.

[21] Appl. No.: 713,894

[22] Filed: Mar. 20, 1985

[51] Int. Cl.[4] ..... B67D 5/06; B65D 88/54

[52] U.S. Cl. ..... 222/182; 222/321; 222/385; 222/562; 215/324

[58] Field of Search ..... 222/321, 383, 384, 385, 222/562, 182, 402.1; 239/331; 215/324; D9/300, 352, 448, 449, 454

[56] References Cited

U.S. PATENT DOCUMENTS

| | | | |
|---|---|---|---|
| D. 260,242 | 8/1981 | Carluccio | D9/352 X |
| 3,746,260 | 7/1973 | Boris . | |
| 3,908,870 | 9/1975 | Nozawa et al. | 222/321 |
| 3,998,363 | 12/1976 | Beres et al. | 222/321 |
| 4,025,046 | 5/1977 | Boris . | |
| 4,057,176 | 11/1977 | Horvath . | |
| 4,173,297 | 11/1979 | Pettersen . | |
| 4,189,064 | 2/1980 | O'Neill . | |
| 4,215,804 | 8/1980 | Giuffredi | 222/383 X |
| 4,230,242 | 10/1980 | Meshberg . | |
| 4,274,560 | 6/1981 | Cater . | |
| 4,278,189 | 7/1981 | Kirk, Jr. . | |
| 4,317,531 | 3/1982 | Saito et al. | 222/321 |
| 4,361,255 | 11/1982 | Saito . | |
| 4,369,900 | 1/1983 | Saito . | |
| 4,434,915 | 3/1984 | Kirk, Jr. | 222/321 X |
| 4,437,588 | 3/1984 | Shay | 222/385 X |

FOREIGN PATENT DOCUMENTS

| | | | |
|---|---|---|---|
| 2230330 | 3/1973 | Fed. Rep. of Germany | 215/324 |
| 2825428 | 6/1978 | Fed. Rep. of Germany . | |

*Primary Examiner*—Joseph J. Rolla
*Assistant Examiner*—Gregory L. Huson
*Attorney, Agent, or Firm*—St. Onge, Steward, Johnston & Reens

[57] ABSTRACT

A mounting cap is disclosed for a container having a shoulder extending to a neck, a neck extending to a flange, an aperture surrounded by the flange, and a pump extending through the aperture, the pump terminating in an actuator button. The mounting cap comprises a cover and a sleeve, the sleeve extending from the cover and surrounding the flange and neck, and also means for mounting the sleeve to the container. In one modification, the mounting cap further comprises a collar extending upward and surrounding the pump. Also disclosed is a method for mounting such a cap onto the container.

3 Claims, 6 Drawing Figures

MOUNTING CAP WITH EXTENDED SLEEVE

BACKGROUND OF THE INVENTION (1) Field Of The Invention

The present invention relates to a mounting cap for a container and a method for capping a container. More specifically, the present invention relates to a mounting cap having an extended sleeve for improving the appearance of a capped container and a method for securing such a mounting cap to a container.

(2) Discussion Of The Prior Art

Mounting caps for containers of the type having a neck terminating in a flange and aperture through which the container contents are dispensed are known. The conventional mounting caps have sleeves that are crimped or otherwise fixed to the flange of the container. These conventional sleeves terminate at the flange and leave the neck of the container exposed. Such a conventional cap emphasizes the neck, the lip of the flange, and the junction between them, thereby detracting from the aesthetic appeal of the capped container.

It is known to use these conventional caps with an additional metal collar that fits over the cap adjacent to and coaxial with the sleeve. This metal collar extends from the top of the cap to a region adjacent the shoulder, thereby shielding from view the neck, the lip of the flange, and the junction therebetween. However, this metal collar increases the cost for parts and assembly time. There are also problems associated with properly fitting the metal collar over the mounting cap.

A typical container may have extending from its aperture a pump that terminates in an actuator button. The sleeve of a conventional mounting cap terminates at the flange and leaves the pump shaft exposed to view. This arrangement further detracts from the container appearance.

SUMMARY OF THE INVENTION

A mounting cap in accordance with the present invention includes a sleeve for extending over the flange, neck and pump portions of the container, thereby achieving improved aesthetic results.

In accordance with one aspect of the present invention, a mounting cap comprises a cover joined to a sleeve completely surrounding a flange and neck of a container, the sleeve thereby blocking the flange and neck portions of the container from view.

In accordance with another aspect of the present invention, a mounting cap includes a cover joined to a collar that surrounds a pump inserted into a container, the pump terminating in an actuator button. In one aspect, the collar terminates inside a chamber in the actuator button. In another aspect the collar terminates outside and above the bottom of the actuator button. In both cases, the pump is completely obstructed from view, resulting in improved aesthetics for the capped container.

In accordance with yet another aspect of the present invention, a method is disclosed for capping a container so that flange and neck portions of the container are obstructed from view. A mounting cap having an extended sleeve is placed over the flange and neck of the container, surrounding both the flange and neck. The sleeve is made of plastically deformable material that can be deformed to retain the deformed shape after removal of the deforming influence. The sleeve material is displaced toward the container adjacent the lip of the flange to secure the sleeve to the container. At the same time, means are provided for restraining the sleeve material from deforming away from or into the container.

Additional advantages of a mounting cap in accordance with the present invention will be apparent from the detailed description of the invention with reference to the drawings.

BRIEF DESCRIPTION OF THE DRAWINGS

FIG. 1 is a side view with a partial cutaway showing a first embodiment of the mounting cap in accordance with the present invention, where the sleeve surrounds the flange and neck of the container;

FIG. 2 discloses a method for applying the mounting cap such as the one shown in FIG. 1 to the container;

FIG. 3 is a side view with a partial cutaway showing a second embodiment of the mounting cap, wherein the sleeve surrounds the flange and neck, and a collar surrounds the pump, the collar terminating inside the actuator button chamber;

FIG. 4 is a side view with a partial cutaway showing a third embodiment of the mounting cap, wherein the sleeve surrounds the flange and the neck, and a collar surrounds the pump and a portion of the actuator button, the collar terminating outside and above the bottom of the actuator button; and FIG. 5 is a side view with a partial cutaway showing a fourth embodiment of the mounting cap on a container having a neck diameter sized to support the sleeve during the mounting.

FIG. 6 is a side view with a partial cutaway showing a fifth embodiment of the mounting cap, wherein a sleeve portion is expanded radially outwardly for providing a surface supporting a top, which encloses the actuator button, pump, and part of the mounting cap.

DETAILED DESCRIPTION OF THE INVENTION

Figure 1:
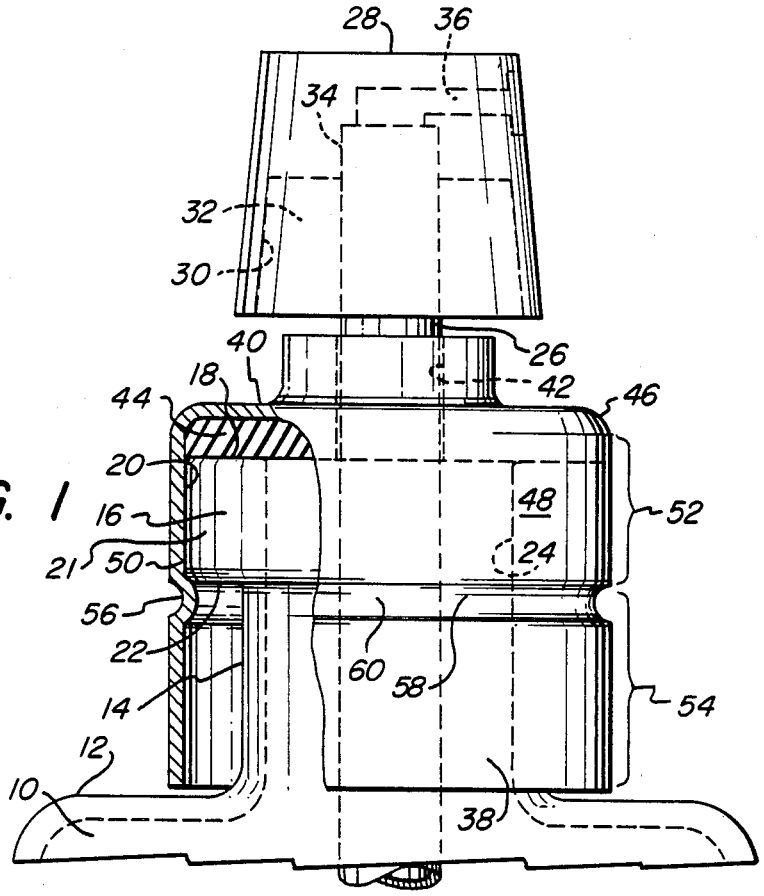
FIGS. 1, 3, 4, 5, and 6 show five different embodiments of the present invention.

FIG. 1 shows the top portion of a container 10, such as a conventional bottle or jar, formed from a material suitable for enclosing a substance to be contained and dispensed. The container 10 includes a shoulder 12 extending to a neck 14, the neck extending to a flange indicated generally as 16. The neck 14 and the flange 16 are typically cylindrical in cross section, although other configurations are possible.

The flange 16 has a top 18, a sidewall 20, and a lip 22. The flange sidewall 20 has a height defined by the vertical distance between the lip 22 and the top 18, the flange sidewall 20 is spaced a lateral distance from the neck 14, and the flange lip 22 is spaced a vertical distance from the shoulder 12. The height, lateral distance, and vertical distance are predetermined by the manufacturing specifications for the container.

The container 10 has an aperture 24 surrounded at the top by the flange 16 for dispensing the substance contained therein. FIG. 1 further shows a pump assembly comprising a pump 26 terminating with an actuator button 28 mounted thereon. The pump 26 extends through the aperture 24 into the container 10 for dispensing the contents by depressing the actuator button 28. Actuator button 28 comprises a sidewall 30 defining a chamber indicated as 32, a means 34 for mounting the pump 26, and a discharge nozzle 36. The pump 26 and actuator button 28 typically are substantially cylindrical in cross section, although other configurations are readily usable. The pump 26 and actuator button 28 may be made of metal or plastic and may be tapered as well as cylindrical. Although a cap in accordance with the present invention is particularly suited for use with a pump, the cap may be used with aerosol dispensers and plug type dispensers.

The mounting cap of the present invention, shown generally as 38 in FIG. 1, has a cover 40 placed adjacent to and across a portion of the top 18 of the flange 16. The cover 40 has an opening 42 vertically aligned with the aperture 24 through which the pump extends. A sealing means 44 is placed between the cover 40 and the top 18 of the flange 16 for achieving a seal between the cover 40 and the flange top 18. The cover 40 has a perimeter 46, which is aligned with the sidewall 20 of the flange 16.

The cover 40 is joined to a sleeve 48 around the perimeter 46 of the cover 40. In FIG. 1, the cover 40 is integrally formed with the sleeve 48, the sleeve 48 being formed about the flange sidewall 20 and flange top 18 to join the cover 40. The sleeve 48 of FIG. 1 is substantially cylindrical in cross section and has a sidewall 50. The portion of the sidewall 50 nearest the shoulder 12 is vertically aligned with the portion of the sidewall 50 adjacent the flange sidewall 20, the sleeve 48 thereby being of substantially uniform cylindrical cross section along its length. The sleeve 48 is formed from a plastically deformable material that retains its deformed shape after the deforming influence is removed. Although both the cover 40 and the sleeve 48 may be integrally formed of a plastically deformable material, as is shown in FIG. 1, the plastically deformable material need be used only at the point where the sleeve is fixed to the container, as described below. Suitable plastically deformable materials would include metals, thermoplastics, or other compositions having similar properties.

The sleeve 48 has a first segment 52 extending the flange sidewall height, from the top 18 of the flange to the lip 22 of the flange, and a second segment 54 spanning the predetermined distance from the lip 22 to a point adjacent the shoulder 12. The sleeve 48 extends downwardly from the cover 40 on all sides around the flange 16 and neck 14, the sleeve sidewall 50 and therefore the sleeve 48 terminating adjacent the shoulder 12. Therefore, the sleeve sidewall 50 completely surrounds the flange 16 and neck 14, obstructing them from view.

FIG. 1 discloses a flange sidewall 20 having a cylindrical face 21. The sleeve 48 in FIG. 1 is substantially cylindrical with sleeve sidewall 50 being likewise cylindrical. In the embodiment of FIG. 1, the first segment 52 of sleeve 48 and its sidewall 50 abut the face 21 of the flange sidewall 20, although in a different embodiment a sealing ring could be employed between the sleeve sidewall and flange face.

In FIG. 1 the sleeve 48 is mounted to the container 10 by a depression 56 or crimp formed in the sidewall 50 around the perimeter of the sleeve 48. This depression 56 is formed by displacing the sleeve material in the second segment 54 of the sleeve toward the container 10 along a path 58 just below the lip 22 of the flange 16. Because the sleeve material is plastically deformable, the displacement is retained to form the depression 56. Use of the plastically deformable material is essential only at the area of the depression 56. The displaced sleeve material abuts the lip 22 and retains the sleeve 48 on the container 10. Where the sleeve is cylindrical, as in FIG. 1, the displaced sleeve material forms an annular ring 60 extending toward the container in abutment with the flange lip 22, thereby retaining the flange between the cover and the annular ring of sleeve material.

Other means for fixing the sleeve 48 onto the container 10 could include an adhesive or some type of conventional mechanical coupling, such as a metal or plastic band tightened about the sleeve and shoulder.

Figure 2:
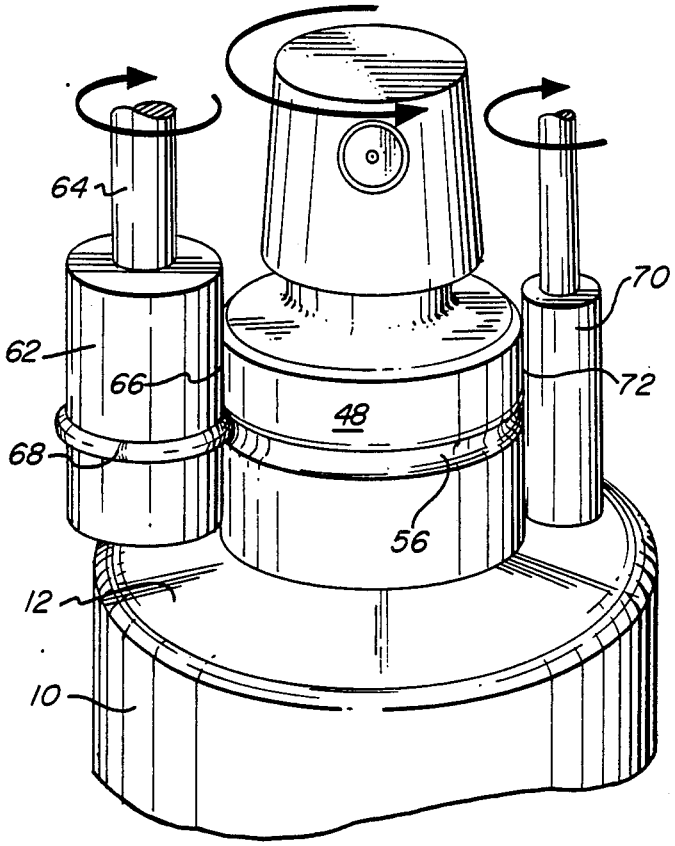
FIG. 2 discloses a method for capping a container in accordance with the present invention.

FIG. 2 in conjunction with FIG. 1 discloses a process for securing the sleeve 48 of FIG. 1 to the container 10. In FIG. 2 the sleeve 48 is placed on the container 10 over the flange 16 and neck 14. The sleeve 48 is long enough to extend adjacent the shoulder 12.

The depression 56 in the sidewall 50 around the perimeter of the sleeve 48 is produced by displacing the sleeve material toward the container. This displacement is accomplished in FIG. 2 by a roller 62, although other displacement means could be used, such as a crimping device, described below. In FIG. 2, roller 62 moves about the perimeter of the sleeve 48. Roller 62 could be mounted by means of shaft 64 to a platen (not shown) supporting roller 62, the platen rotating and thereby moving roller 62 about the perimeter of the sleeve 48. Alternatively, the roller 62 can be held in one position and container 10 can be rotated.

Roller 62 comprises a roller face 66 defined by a cylinder coaxial with the shaft 64, roller face 66 laying parallel to and in contact with the sidewall 50 of the sleeve 48. Roller face 66 has a raised surface 68 around the perimeter of roller 62. The raised surface 68 contacts the sleeve sidewall 50, displaces the sleeve material toward the container abutting the lip 22, and forms the depression 56 in the sidewall 50 when the roller moves with respect to the sleeve perimeter.

Roller 62 with raised surface 68 is positioned relative to the sleeve 48 so that the sleeve material is displaced toward the container along the path 58 adjacent and beneath the lip flange 22. By referring to FIG. 1, it is seen that the material displaced by the action of the roller 62 presses the sleeve against lip 22, thereby retaining sleeve 48 onto container 10.

In accordance with one aspect of the invention, the roller 62 may extend downwardly from raised surface 68 the entire length of the sleeve 48 to an area adjacent the shoulder 12 and upwardly at least as far as the cover 40. Roller face 66 is aligned along its length with the sleeve sidewall 50 to simultaneously restrain the sleeve material from being deformed away from the container during the displacement action of roller surface 68. Retaining the sleeve 48 from deforming outwardly during the displacement operation provides a cap having a substantially cylindrical appearance and keeps the neck 14 of container 10 shielded from view.

A companion roller 70 as shown in FIG. 2 is optional Roller 70 is located opposite roller 62 and has a roller face 72 aligned with the sidewall 50 of sleeve 48. Roller face 72 is parallel to and contacts the sidewall 50 of sleeve 48 opposite roller face 66. When moved synchronously with roller 62, roller 70 restrains the sleeve material from further deformation.

It is further understood that in accordance with the disclosure herein a plurality of rollers could be used if the rollers were spaced around the perimeter of the sleeve.

The depression 56 or its equivalent could also be achieved by means of a crimping device, where the mounting cap with the extended sleeve is placed on the container 10 over the neck 14 and flange 16. A crimping mechanism with crimping fingers disposed radially inward towards the container 10 is positioned for crimping action along path 58. Each crimping finger indents the sleeve material at a point along path 58. With a sufficient number of crimping operations and resulting indentations around the sleeve, the sleeve would be retained on the container. A means similar to the roller 62 would restrain the sleeve material from being deformed outwardly away from the container.

Figure 3:
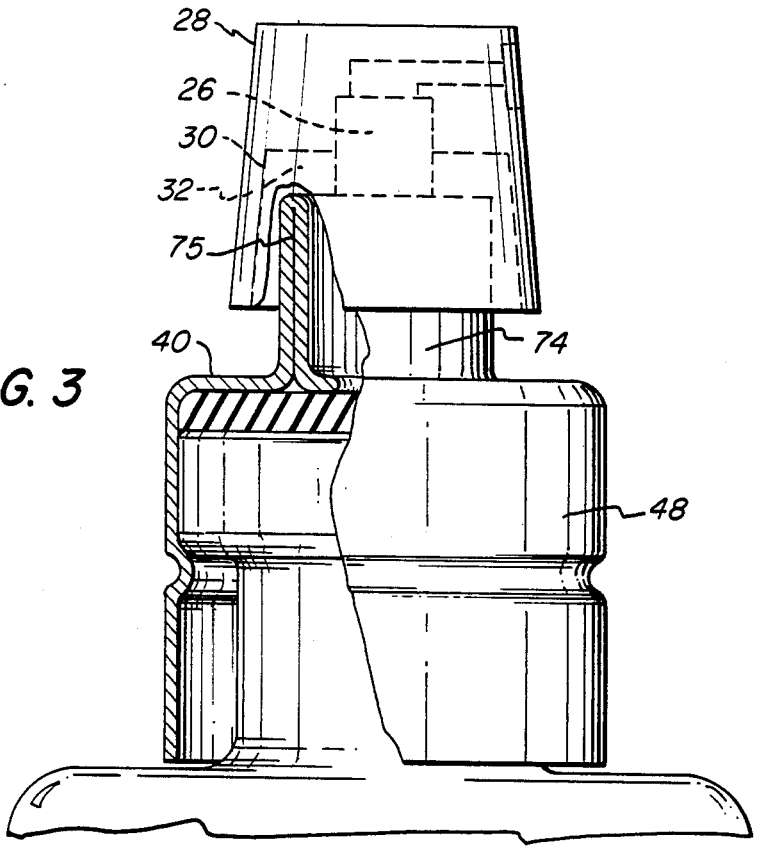

FIG. 3 discloses another embodiment of the mounting cap in accordance with the present invention. FIG. 3 shows the cap of FIG. 1 where the sleeve 48 extends downward from the cover 40, with a modification whereby a collar 74 joined to the cover 40 extends upward to surround and obstruct view of the pump 26. The cover 40 is integrally formed with a sidewall 75 that extends upward in vertical alignment with a chamber 32 defined by the sidewall 30 of the actuator button 28. The sidewall 75 extends upward to a point above the bottom of the actuator button 28 and is then bent approximately 180° back along itself to extend downward where it rejoins the cover 40. In FIG. 3 collar 74 is substantially cylindrical and is of substantially uniform cross section, although other configurations are useful as well. The diameter of the collar 74 can vary, as long as it fits inside the chamber 32.

Figure 4:
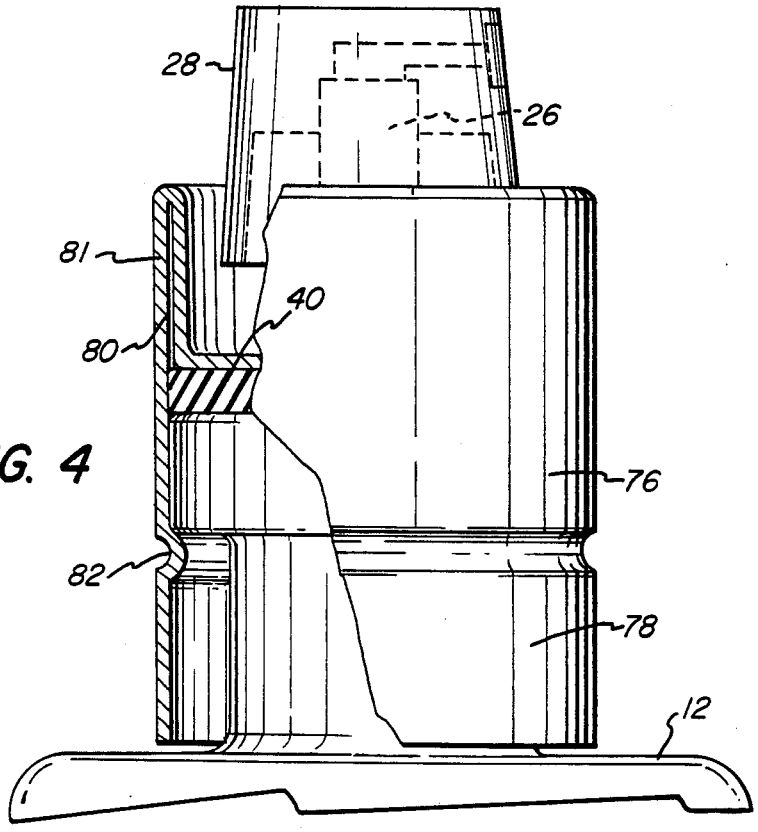

FIG. 4 shows yet another embodiment modifying the embodiment of FIG. 1. In FIG. 4, the mounting cap 76 has a sleeve 78 with first and second segments as shown in FIG. 1, the sleeve extending downward from the cover 40 and terminating adjacent the shoulder 12. FIG. 4 discloses the modification whereby the sleeve joins a collar portion 80 extending upward above and adjacent the bottom of the actuator button 28. The collar 80 has a sidewall 81 that extends upward in vertical alignment with the first sleeve segment to a point above the bottom of the actuator button 28. The collar sidewall 81 is then bent approximately 180° back along itself and then extends downward where it joins the cover 40 substantially adjacent to the perimeter, being integrally formed therewith. In FIG. 4 the collar 80 surrounds a portion of the actuator button 28, as opposed to FIG. 3, where the collar 74 terminates inside the actuator button chamber. In FIG. 4 the collar 80 surrounds and obstructs from view the pump 26 and a portion of the actuator button 28. The sleeve 78 also shields the neck 14 and flange 16 from view. The sleeve 78 has a depression 82 for securing the sleeve to the container, as was disclosed in FIGS. 1 and 2.

While FIGS. 3 and 4 disclose sleeves surrounding the flange and the neck, and also collars surrounding the pump, it is possible to use a collar that surrounds the pump, the collar being joined to a sleeve that extends downwardly only as far as the lip 22 of the flange 16, thereby covering the pump 26 and flange 16, but leaving the neck exposed.

Figure 5:
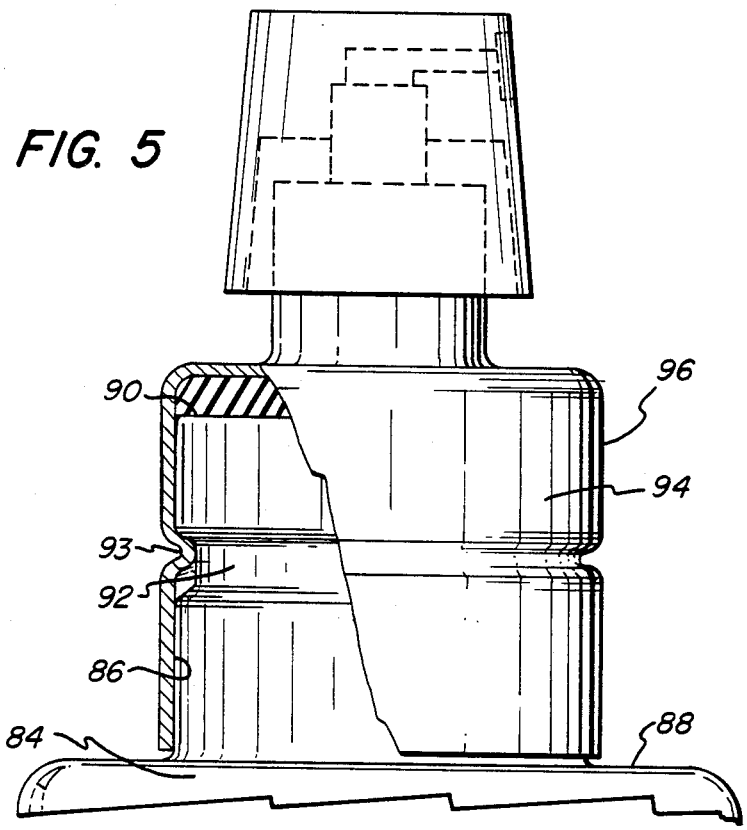

FIG. 5 shows a container 84 similar to container 10 shown in FIG. 1, except that the neck 86 of container 84 extends from the shoulder 88 and terminates at a top 90, the neck having a groove 92 therein around its perimeter. In comparison with container 10 of FIG. 1, container 84 in effect has a flange sidewall aligned vertically with the neck, and the flange lip of container 10 corresponds to the groove 92 of container 84. The mounting cap 94 has a sleeve 96 that fits over the neck obstructing the neck 86 from view. The sleeve 96 is secured to the neck 86 by displacing the sleeve material into part of the groove 92, thereby forming the depression 93 which is substantially aligned with the groove 92.

Figure 6:
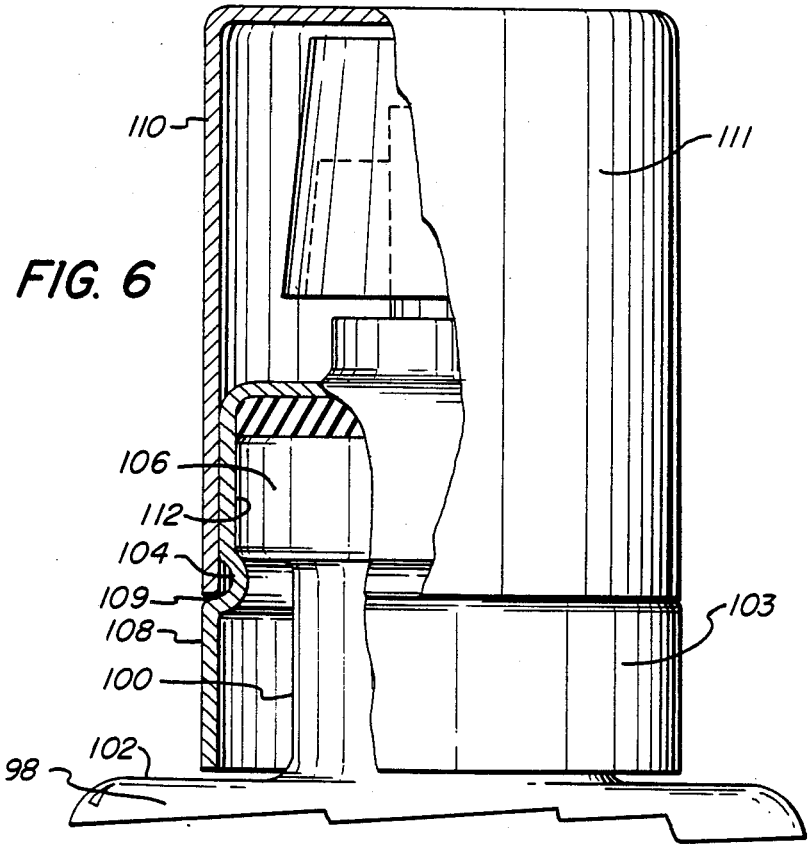

FIG. 6 shows a container 98 substantially identical to the container described in FIG. 1 above. Container 98 has a neck portion 100, a shoulder portion 102, and a flange portion 106. The mounting cap assembly shown in FIG. 6 has two components. The first is a mounting cap 103 substantially as described in FIG. 1, with the modification whereby the second sleeve segment 108 is expanded radially outward from the neck 100 a preselected displacement so that a support surface 109 is formed adjacent the lip of the flange and adjacent the annular ring of displaced sleeve material 104, which secures the mounting cap to the container 98.

The second part of the mounting cap assembly shown in FIG. 6 is a top 111 having a sidewall portion 110 that is supported by the support surface 109 formed by the outward radial expansion of the second sleeve segment. The top sidewall 110 slidably abuts the sidewall 112 of the first sleeve segment, so that the top slides over the first sleeve segment to rest on the support surface 109 formed by the second sleeve segment. The top extends upwardly to surround and obstruct from view the annular ring, the first sleeve segment, the cover, the pump, and the actuator button.

It should be understood that although specific embodiments of the invention have been described herein in detail, such description is for purposes of illustration only and modifications may be made thereto by those skilled in the art within the scope of the invention.

I claim:

1. A mounting cap for use on a container having a shoulder extending to a neck, the neck extending to a flange having a top, a sidewall, and a lip, the flange surrounding an aperture for dispensing contents from the container, the flange sidewall having a height and the lip of the flange is spaced a predetermined distance from the shoulder, the container further having a pump extending through the aperture, the pump terminating in an actuator button, the mounting cap comprising:

(a) a cover adjacent the top of the flange and aperture, the cover located across at least a portion of the top of the flange and having an opening aligned with the aperture, the pump extending through the opening, the cover having a perimeter aligned with the sidewall of the flange;

(b) a first sleeve segment joining the cover around the perimeter, the first sleeve segment having a sidewall extending downward from the cover the height of the flange sidewall;

(c) a second sleeve segment joining the first sleeve segment adjacent the lip of the flange, the second sleeve segment spanning the predetermined distance and comprising an annular ring extending toward the container and located in abutment with the flange lip to retain the flange between the cover and the ring, the second sleeve segment further comprising a sidewall of substantially uniform cross section along its length joined to the annular ring and being expanded radially outward to form a support surface; and (d) a top having a sidewall slidably abutting the first sleeve segment sidewall, the bottom of the top sidewall being removably supported on the support surface formed by the second sleeve segment, the top sidewall portion extending from the support surface upwardly to an area above the top of the actuator button to surround and obstruct from view the annular ring, the first sleeve segment, the cover, the pump, and the actuator button, the top sidewall portion being substantially aligned with the second sleeve sidewall, whereby the top and the second sleeve segment form a substantially uniform outer surface for obstructing from view the annular ring, the first sleeve segment, the cover, the pump, and the actuator button.

2. A mounting cap for use on a container having a shoulder extending to a neck, the neck extending to a flange having a top, a sidewall, and a lip, the flange surrounding an aperture for dispensing contents from the container, the flange sidewall having a height and the lip of the flange is spaced a predetermined distance from the shoulder the container:

(a) a cover adjacent the top of the flange and aperture, the cover located across at least a portion of the top of the flange, and having an opening aligned with the aperture, the pump extending through the opening, the cover having a perimeter aligned with the sidewall of the flange;

(b) a sleeve joining the cover around the perimeter, the sleeve having a first segment extending the flange sidewall height, the sleeve including a second segment spanning the predetermined distance, the sleeve thereby extending from the cover and terminating adjacent the shoulder, the sleeve surrounding the flange and neck to thereby obstruct view of the flange and neck;

(c) a collar joining the cover, extending from the cover, and terminating inside the actuator button chamber, the collar joining the cover at a point aligned with the chamber defined by the actuator button, the collar comprising a sidewall extending upwardly to a point at least above the bottom of the actuator button, the collar sidewall then being bent back along itself and extending downwardly and rejoining the cover, the collar surrounding the pump to thereby obstruct view of the pump; and (d) means for mounting the sleeve to the container.

3. A mounting cap for use on a container having a shoulder extending to a neck, the neck extending to a flange having a top, a sidewall, and a lip, the flange sidewall having a height and the lip of the flange being spaced a predetermined distance from the shoulder, the flange surrounding an aperture for dispensing contents from the container, the container further having a pump extending through the aperture, the pump terminating in an actuator button, the mounting cap comprising:

(a) a cover adjacent the top of the flange and aperture, the cover located across at least a portion of the top of the flange and having an opening aligned with the aperture, the pump extending through the opening, the cover having a perimeter aligned with the sidewall of the flange;

(b) a sleeve joining the cover around the perimeter, the sleeve extending from the cover and terminating adjacent the shoulder, the sleeve surrounding the flange and neck to thereby obstruct view of the flange and neck, said sleeve having a first segment extending the flange sidewall height, the sleeve including a second segment spanning the predetermined distance;

(c) a collar joining the sleeve, extending from the sleeve, and terminating adjacent the actuator button, the collar surrounding the pump and a portion of the actuator button to thereby obstruct view of the pump and a portion of the actuator button, the collar joining the sleeve being substantially aligned with the sleeve, the collar comprising a sidewall extending upward to a point at least above the bottom of the actuator button, the collar sidewall then being bent back along itself and extending downward and joining the cover substantially adjacent to the perimeter; and (d) means for mounting the sleeve to the container.

* * * * *